US006703773B2

(12) United States Patent
Ha et al.

(10) Patent No.: US 6,703,773 B2
(45) Date of Patent: Mar. 9, 2004

(54) TENSION MASK FRAME ASSEMBLY OF COLOR CATHODE-RAY TUBE

(75) Inventors: Kuen-dong Ha, Seoul (KR); Jong-in Jeong, Suwon (KR); Gui-bae Kim, Seongnam (KR)

(73) Assignee: Samsung SDI Co., Ltd., Suwon (KR)

( * ) Notice: Subject to any disclaimer, the term of this patent is extended or adjusted under 35 U.S.C. 154(b) by 191 days.

(21) Appl. No.: 09/835,387

(22) Filed: Apr. 17, 2001

(65) Prior Publication Data

US 2001/0033130 A1 Oct. 25, 2001

(30) Foreign Application Priority Data

Apr. 21, 2000 (KR) ..... 2000-21179

(51) Int. Cl.[7] ..... H01J 29/80
(52) U.S. Cl. ..... 313/407
(58) Field of Search ..... 313/402, 407, 313/404, 406

(56) References Cited

U.S. PATENT DOCUMENTS

| | | | | |
|---|---|---|---|---|
| 3,652,895 A | | 3/1972 | Tsuneta et al. | |
| 4,168,450 A | | 9/1979 | Yamauchi et al. | |
| 4,300,069 A | | 11/1981 | Nolan | |
| 4,495,437 A | | 1/1985 | Kume et al. | |
| 4,678,963 A | | 7/1987 | Fonda | |
| 4,794,299 A | | 12/1988 | Chiodi et al. | |
| 4,798,992 A | * | 1/1989 | Ichigaya et al. | 313/406 |
| 4,915,658 A | | 4/1990 | Lopata et al. | |
| 4,942,332 A | * | 7/1990 | Adler et al. | 313/402 |
| 4,973,283 A | | 11/1990 | Adler et al. | |
| 5,030,880 A | | 7/1991 | An | |
| 5,111,107 A | | 5/1992 | Kume et al. | |
| 5,355,049 A | | 10/1994 | Sung | |
| 5,523,647 A | | 6/1996 | Kawamura et al. | |
| 5,576,595 A | * | 11/1996 | Inoue | 313/402 |
| 5,644,192 A | | 7/1997 | Ragland, Jr. | |
| 5,856,725 A | | 1/1999 | Ueda | |
| 5,877,586 A | | 3/1999 | Aibara | |
| 5,898,259 A | | 4/1999 | Reyal | |
| 5,932,957 A | | 8/1999 | Ragland, Jr. | |
| 6,057,640 A | | 5/2000 | Aibara | |
| 6,140,754 A | | 10/2000 | Ko | |
| 6,437,496 B1 | * | 8/2002 | Kim et al. | 313/402 |
| 6,459,194 B1 | * | 10/2002 | Akita | 313/402 |

* cited by examiner

*Primary Examiner*—Sandra O'Shea
*Assistant Examiner*—Sumati Krishnan
(74) *Attorney, Agent, or Firm*—Robert E. Bushnell, Esq.

(57) ABSTRACT

A tension mask frame assembly for a color cathode-ray tube, the assembly including a tension mask and a frame, is provided. The tension mask has a plurality of strips isolated from each other at predetermined intervals on a thin plate to form slots, and tie bars for partitioning slots at a predetermined pitch interval by connecting adjacent strips to each other. The frame has a pair of support members for supporting the longer sides of the tension mask, a pair of elastic members, the ends of which are connected to both ends of each of the support members so that the support members are isolated from each other a predetermined distance, and a reinforcing member having both ends coupled to both ends of the exterior side surface of each of the support members and its center portion contacting with the exterior side surface of each of the support members, the reinforcing member for elastically restoring the support members in a direction where a tensile force is applied to the strips. In the tension mask frame assembly for a color cathode-ray tube having such a structure, deformation of the support members is reduced by the reinforcing member, so that a uniform tensile force is applied to the tension mask supported by the supporters.

22 Claims, 3 Drawing Sheets

TENSION MASK FRAME ASSEMBLY OF COLOR CATHODE-RAY TUBE

CLAIM OF PRIORITY

This application makes reference to, incorporates the same herein, and claims all benefits accruing under 35 U.S.C. §119 from an application entitled Tension Mask Frame Assembly of the Color Picture Tube earlier filed in the Korean Industrial Property Office on Apr. 21, 2000, and there duly assigned Serial No. 2000-21179 by that Office.

BACKGROUND OF THE INVENTION

1. Field of the Invention

The present invention relates to color cathode ray tubes (color CRTS), and more particularly, to a tension mask frame assembly of a color cathode-ray tube having an improved frame for supporting a tension mask.

2. Description of the Background Art

In color cathode-ray tubes, three electron beams emitted from an electron gun land on the red, green and blue fluorescent materials of a fluorescent film formed on a screen surface of a panel through electron beam passing holes, and excite the fluorescent materials to form an image.

A surface of a screen of a typical color cathode-ray tube is designed to have a predetermined curvature considering the trace of the electron beam emitted from the electron gun. The shadow mask is designed to have a curvature corresponding to that of the surface of the screen. However, the curved shadow mask bulges toward the panel by being heated by the electron beam emitted from the electron gun, which is referred to as a doming phenomenon. The doming phenomenon prevents the electron beam from accurately landing on a fluorescent surface.

Recently, color cathode-ray tubes are pursuing flattening of the surface of a screen in order to widen the view angle of an image and prevent distortion of an image. Accordingly, a mask having a color distinguishing function, which is installed within a cathode-ray tube, must be flattened. The mask becomes an obstacle to manufacture a cathode-ray tube having a flat screen. In order to realize a flat surface, a tension force is applied to the shadow mask of a flat cathode-ray tube.

A tension mask frame assembly may include a frame and a flat tension mask. The frame has first and second support members that are installed in parallel. The frame also includes first and second elastic members connected to the first and second support members. The first and second support members are spaced a predetermined distance from each other. The flat tension mask has slots formed by a plurality of strips isolated from each other at predetermined intervals, and two longer edges of the flat tension mask are welded with the first and second support members, respectively, by receiving a tensile force.

The strips are connected to each other by tie bars isolated from each other at predetermined intervals, thereby forming the slots. In this tension mask frame assembly, the tension mask supported by the first and second support members cannot receive a uniform tensile force over the entire surface. That is, in order to weld the tension mask to the first and second support members of the frame, first, the first and second elastic members and are pressurized and elastically deformed so that the first and second support members are displaced in facing directions. Next, in this state, both longer sides of the tension mask are welded to the first and second support members, respectively, and then the pressure having been put on the first and second elastic members is removed. At this time, the first and second support members is subjected to a restoring force by the elasticity of the first and second elastic members. This restoring force to the first and second support members is different at portions supported by the first and second elastic members than from the center portions.

The difference in restoring force between portions of the first and second support members is represented as the difference between tensile forces applied to the strips of the tension mask welded with the first and second support members. A tensile force applied to the strips of the tension mask is large at portions supported by the first and second elastic members and, whereas a tensile force applied to the strips is small at portions other than the portions supported by the first and second elastic members.

The difference in tensile force causes deformation of the slits through which electron beams pass, since the tension mask is partially diminished or expanded without sufficiently absorbing the thermal expansion amount at the center portion due to electron beams. The deformation of the slits hinders in accurate landing of electron beams emitted from the electron gun of a cathode-ray tube at predetermined positions on a fluorescent film, and makes the amount of an electron beam passing through a slot different according to portions of the tension mask. Thus, an image having a uniform resolution cannot be obtained. Also, portions on which relatively small tensile forces are applied severely vibrate even by small external impacts, so that screen jitter occurs.

U.S. Pat. No. 5,111,107 issued to Kume, et al. for GRID APPARATUS FOR A COLOR CATHODE RAY TUBE WHICH ELIMINATES VIBRATION OF THE GRIDS discloses a grid apparatus for color cathode-ray tubes, having a plurality of ribbon-shaped grid elements stretched in tension and attached to a frame which includes a pair of support bars and a pair of resilient support members. Metallic members which have a larger thermal expansion coefficient than the resilient support members are connected to the reverse surfaces of the resilient support members opposite the side of where the grid elements are attached.

In the grid apparatus having such a configuration, during heat treatment, thermal creep of the grid elements is prevented so that the tension of the grid elements will remain high when the normal temperature state is resumed. However, in the above-described color cathode-ray tube grid apparatus, the support bars are supported only by the resilient support members, so that the aforementioned problems remain.

Further exemplars of the art are U.S. Pat. No. 5,355,049 issued to Sung for ASSEMBLY OF SHADOW MASK FRAME WITH INNER SHIELD FOR COLOR CATHODE RAY TUBE, U.S. Pat. No. 5,898,259 issued to Reyal for SHADOW MASK FRAME OF A CATHODE RAY TUBE, ITS PROCESS OF MANUFACTURE, AND SUSPENSION ELEMENT OF A SHADOW MASK FRAME, U.S. Pat. No. 4,678,963 issued to Fonda for SHADOW MASK FOR A COLORED IMAGE TUBE AND IMAGE TUBE COMPRISING THE SAME, U.S. Pat. No. 5,877,586 issued to Aibara for SLOT-TYPE SHADOW MASK, U.S. Pat. No. 5,030,880 issued to An for SHADOW MASK FOR COLOR CATHODE RAY TUBE, U.S. Pat. No. 3,652,895 issued to Tsuneta et al. for SHADOW-MASK HAVING GRADUATED RECTANGULAR APERTURES, U.S. Pat. No. 5,856,725 issued to Ueda for SHADOW MASK WITH EDGE SLOTS CONFIGURATION, U.S. Pat. No. 4,168,450 issued to Yamauchi et al. for SLOT TYPE SHADOW MASK, U.S. Pat. No. 4,300,069 issued to Nolan for COLOR PICTURE TUBE HAVING IMPROVED SLIT TYPE SHADOW MASK AND METHOD OF MAKING SAME, U.S. Pat. No. 4,973,283 issued to Alder et al. for METHOD OF MANUFACTURING A TIED SLIT MASK CRT, U.S. Pat. No. 4,942,332 bit issued to Alder et al. for TIED SLIT MASK FOR CATHODE RAY TUBES, U.S. Pat. No. 5,523,647 issued to Kawamura et al. for COLOR CATHODE RAY TUBE HAVING IMPROVED SLOT TYPE SHADOW MASK, U.S. Pat. No. 6,057,640 issued to Aibara for SHADOW MASK FOR COLOR CATHODE RAY TUBE WITH SLOTS SIZED TO IMPROVE MECHANICAL STRENGTH AND BRIGHTNESS, U.S. Pat. No. 6,140,754 issued to Ko for STRUCTURE OF SHADOW MASK FOR FLAT CATHODE RAY TUBE, U.S. Pat. No. 4,794,299 issued to Chiodi et al. for FLAT TENSION MASK COLOR CRT FRONT ASSEMBLY WITH IMPROVED MASK FOR DEGROUPING ERROR COMPENSATION, U.S. Pat. No. 4,915,658 issued to Lopata et al. for REFERENCE AND SUPPORT SYSTEM FOR FLAT CRT TENSION MASK, U.S. Pat. No. 5,932,957 issued to Ragland, jr. for CATHODE-RAY TUBE HAVING DETENTIONING ROD ASSEMBLY FOR A TENSION MASK FRAME, U.S. Pat. No. 5,644,192 issue to Ragland, jr. for COLOR PICTURE HAVING A TENSIONED MASK AND COMPLIANT SUPPORT FRAME ASSEMBLY, and U.S. Pat. No. 4,495,437 issued to Kume et al. for GRID APPARATUS FOR USE WITH A COLOR CATHODE RAY TUBE.

SUMMARY OF THE INVENTION

It is therefore an object of the present invention to provide a tension mask frame assembly for a color cathode ray tube in which a partial distortion of the tension mask due to application of non-uniform tensile forces to the tension mask supported by the support members of a frame is prevented by improving the structural integrity of the support members, so that the electron beam color distinguishing function of a tension mask is improved.

To achieve the above objects, the present invention provides a tension mask frame assembly for a color cathode-ray tube, the assembly including a tension mask having a plurality of strips isolated from each other at predetermined intervals on a thin plate to form slots, and tie bars for partitioning slots at a predetermined pitch interval by connecting adjacent strips to each other; and a frame having a pair of support members for supporting the longer sides of the tension mask, a pair of elastic members, the ends of which are connected to both ends of each of the support members so that the support members are isolated from each other a predetermined distance, and a reinforcing member having both ends coupled to both ends of the exterior side surface of each of the support members and its center portion contacting with the exterior side surface of each of the support members, the reinforcing member for elastically restoring the support members in a direction where a tensile force is applied to the strips.

In the present invention, preferably, both ends of each of the reinforcing members are secured at positions on the exterior side surface of each of the support members where the support members are supported by the elastic members, and the center portion thereof is joined to the center portion of the exterior side surface of each of the support members supported by the elastic members.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
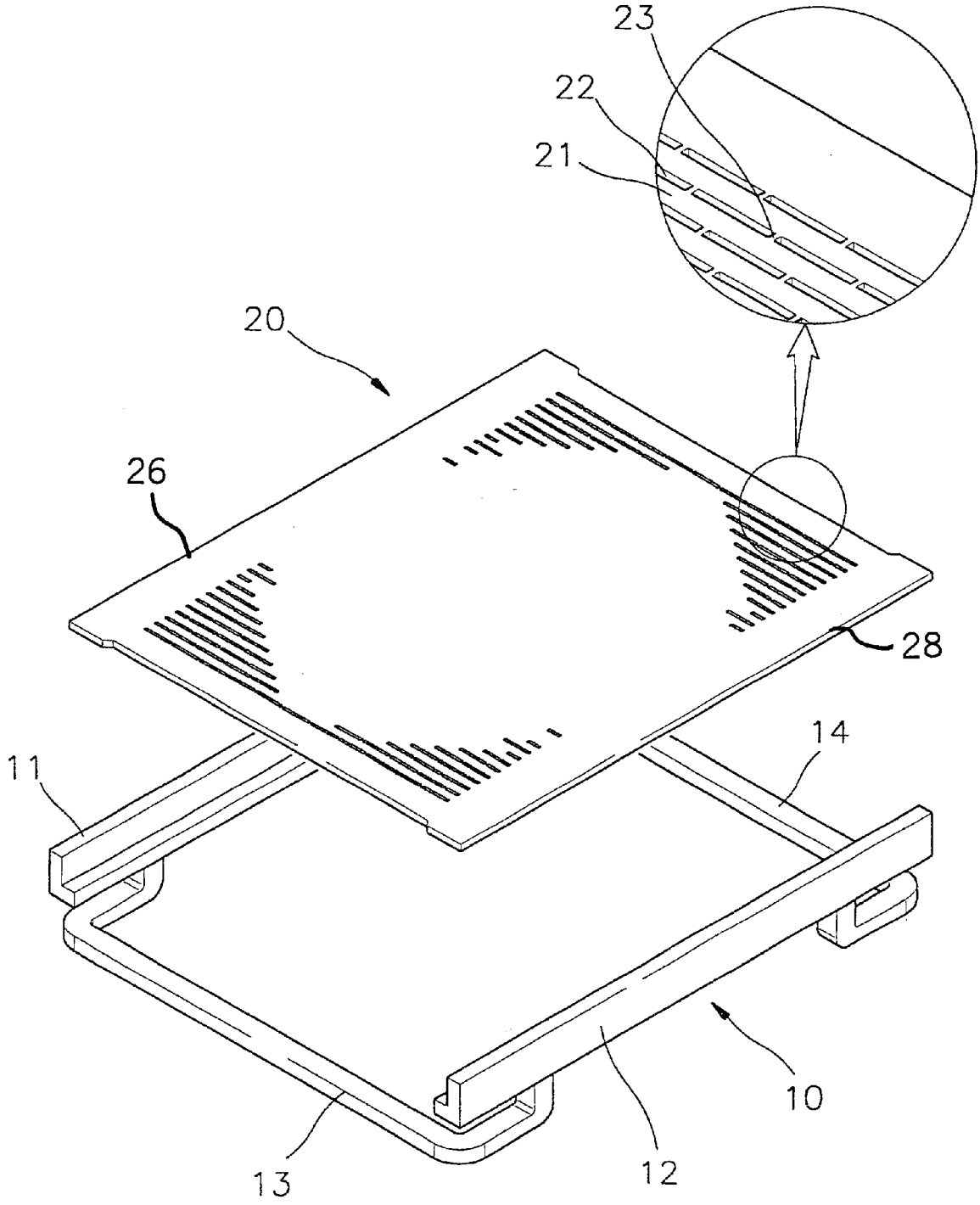
FIG. 1 is a perspective view of a tension mask frame assembly for a flat color cathode-ray tube.

FIG. 1 shows an example of a tension mask frame assembly for a color cathode-ray tube. Referring to FIG. 1, the tension mask frame assembly includes a frame 10 and a flat tension mask 20. The frame has first and second support members 11 and 12 installed in parallel and first and second elastic members 13 and 14 connected to the first and second support members 11 and 12 such that the first and second support members 11 and 12 are spaced a predetermined distance from each other. The flat tension mask 20 has slots 22 formed by a plurality of strips 21 isolated from each other at predetermined intervals. The two longer edges 26 and 28 of the flat tension mask 20 are welded with the first and second support members 11 and 12, respectively, by receiving a tensile force.

The strips 21 are connected to each other by tie bars 23 isolated from each other at predetermined intervals, thereby forming the slots 22. In this tension mask frame assembly, the tension mask 20 supported by the first and second support members 11 and 12 cannot receive a uniform tensile force over the entire surface.

That is, in order to weld the tension mask 20 to the first and second support members 11 and 12 of the frame 10, first, the first and second elastic members 13 and 14 are pressurized and elastically deformed so that the first and second support members 11 and 12 are displaced in facing directions. Next, in this state, both longer sides 26 and 28 of the tension mask 20 are welded to the first and second support members 11 and 12, respectively, and then the pressure having been put on the first and second elastic members 13 and 14 is removed. At this time, the first and second support members 11 and 12 are subjected to a restoring force by the elasticity of the first and second elastic members 13 and 14. This restoring force to the first and second support members 11 and 12 is different at portions of the support members 11 and 12 supported by the first and second elastic members than from the center portions of the first and second support members 11 and 12.

Figure 2:
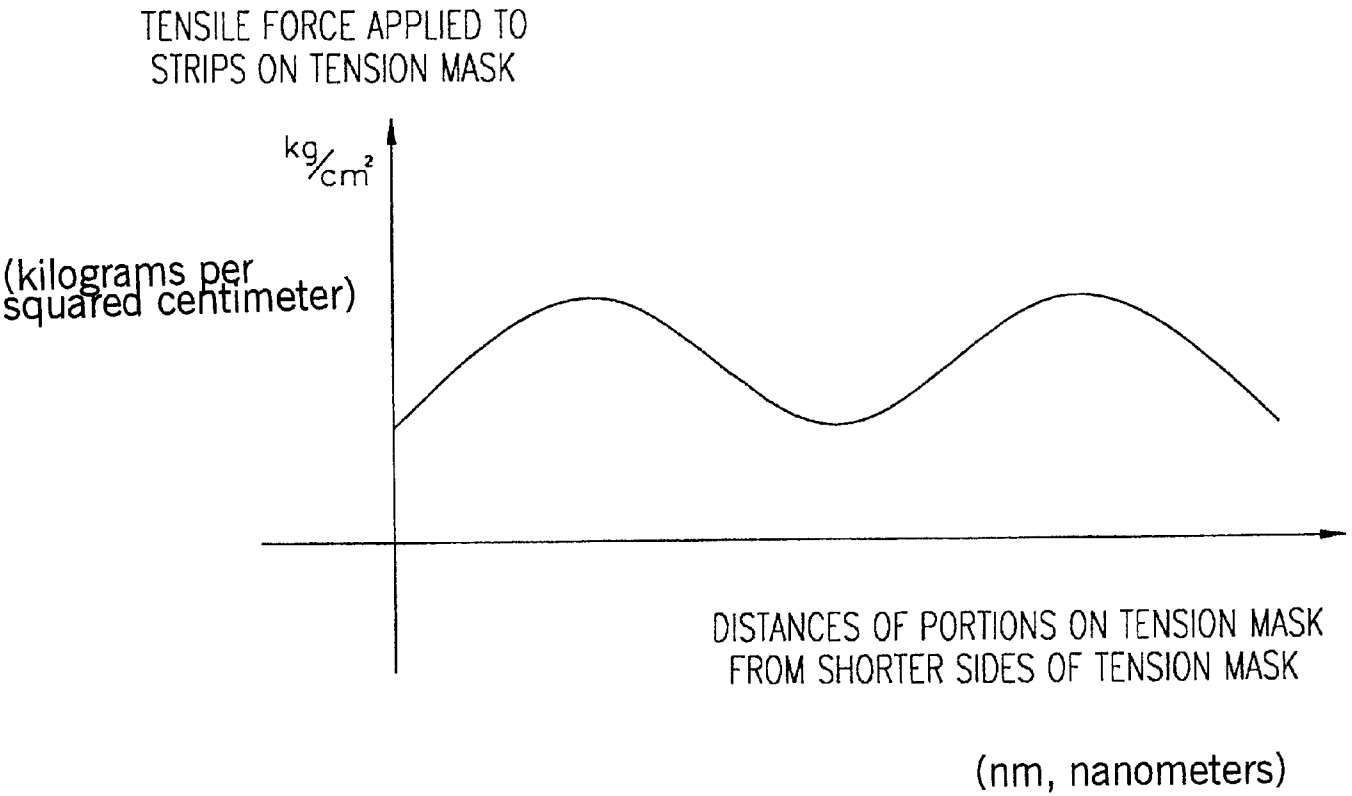
FIG. 2 is a graph showing tensile forces applied to portions of a tension mask supported by a frame.

The difference in restoring force between portions of the first and second support members 11 and 12 is represented as the difference between tensile forces applied to the strips 21 of the tension mask welded with the first and second support members. As shown in the graph of FIG. 2, a tensile force applied to the strips of the tension mask 10 is large at portions supported by the first and second elastic members 13 and 14, whereas a tensile force applied to the strips 21 is small at portions other than the portions supported by the first and second elastic members 13 and 14.

The difference in tensile force causes deformation of the slits 22 through which electron beams pass, since the tension mask 20 is partially diminished or expanded without sufficiently absorbing the thermal expansion amount at the center portion due to electron beams. The deformation of the slits 22 hinders an accurate landing of electron beams emitted from the electron gun of a cathode-ray tube at predetermined positions on a fluorescent film, and makes the amount of an electron beam passing through a slot different according to portions of the tension mask. Thus, an image having a uniform resolution cannot be obtained. Also, portions on which relatively small tensile forces are applied severely vibrate even by small external impacts, so that screen jitter occurs.

Figure 3:
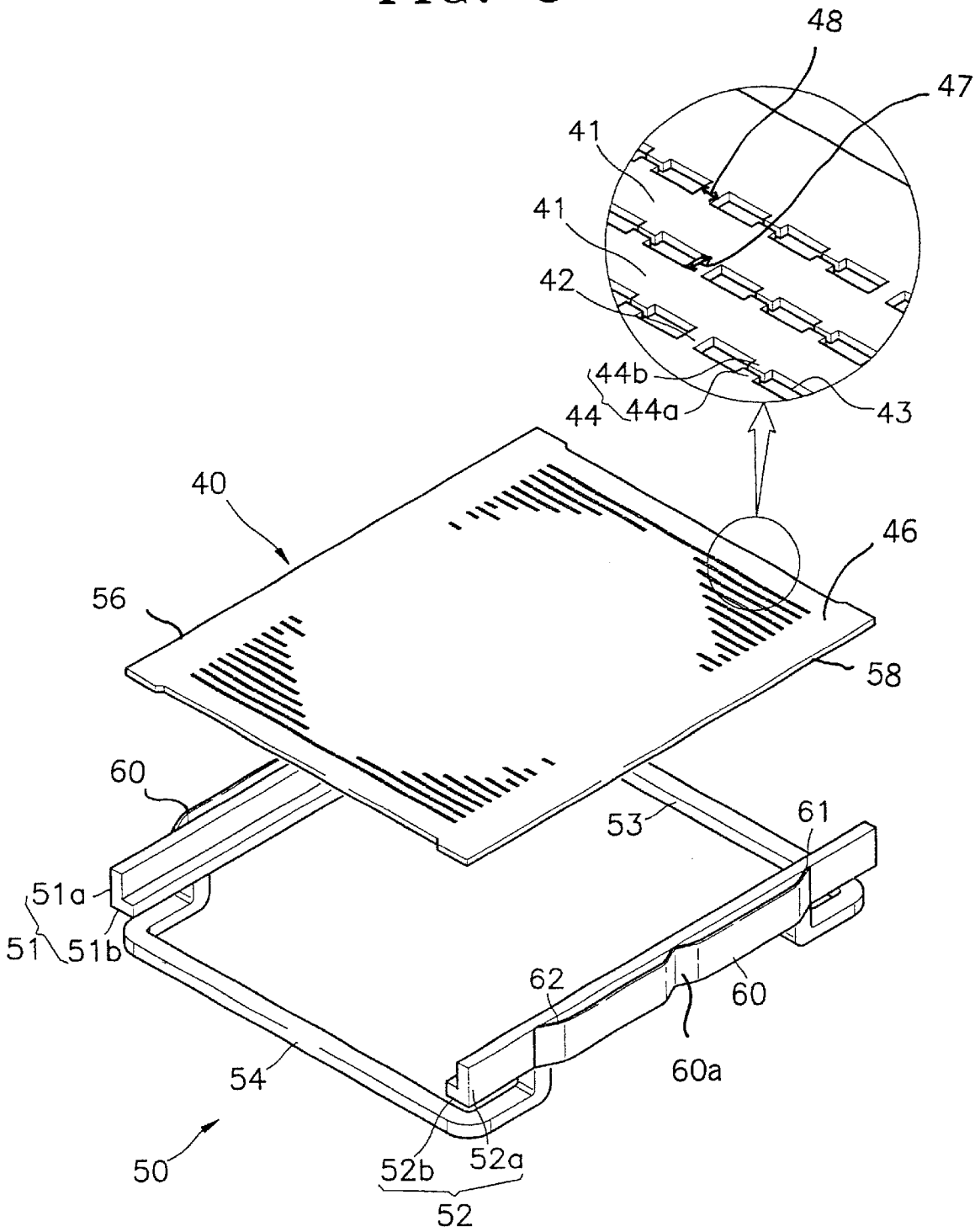
FIG. 3 is an exploded perspective view of a tension mask frame assembly according to the present invention.

Referring to FIG. 3, a tension mask frame assembly for a color cathode-ray tube includes a tension mask 40 having an electron beam color distinguishing function, and a frame 50 for supporting the tension mask 40 while applying a predetermined tensile force to the tension mask 40.

In the tension mask 40, a plurality of strips 41 spaced at predetermined intervals 47 are formed on a thin plate 46, and adjacent strips 41 are connected to each other via a tie bar 42 having a predetermined horizontal pitch 48 to thus form a plurality of slots 43. Dummy bridges 44 extending from adjacent strips 41 are formed on each of the slots 43 defined by a tie bar 42 and adjacent strips 41. Each one of the dummy bridges 44 is made up of first and second protrusions 44*a* and 44*b* extending from two adjacent strips in facing directions. Here, the first and second protrusions 44*a* and 44*b* extending in facing directions do not contact each other. The dummy bridges are not necessarily required by the tension mask.

The frame 50 for supporting the tension mask formed as described above includes first and second support members 51 and 52 for supporting the longer sides of the tension mask 40, respectively, and first and second elastic members 53 and 54 which connect the support members 51 and 52 to each other and support them. The first and second support members 51 and 52 include supporters 51*a* and 52*a* that are welded with the longer sides, 56 and 58 respectively, of the tension mask 40, respectively, and flanges 51*b* and 52*b* extending inwardly from the supporters 51*a* and 52*a*, respectively. A reinforcing member 60 for uniformly maintaining the supporting force of each of the first and second support members 51 and 52 to the tension mask is installed on the outer side of each of the supporters 51*a* and 52*a*.

Preferably, both ends of the reinforcing member 60 are secured near portions of each of the first and second support members 51 and 52 contacting the ends of the first and second elastic members 53 and 54. However, both ends of the reinforcing member 60 can be welded with both ends of each of the first and second support members 51 and 52. The center portion 60*a* of the reinforcing member 60 is joined to the center of each one of the first and second support members 51 and 52. The center portion of the reinforcing member 60 between portions of each one of the first and second support members 51 and 52 is coupled to the first and second elastic members 53 and 54, such that the reinforcing member 60 restores the first and second support members 51 and 52 elastically outward. It is apparent that the position of the junction is not limited to this embodiment and can vary according to the tension state of a tension mask supported by the first and second support members 51 and 52.

The reinforcing member 60 is made of a flat bar having a width that is smaller than or equal to the width of the supporters 51*a* and 52*a*, and both ends of the reinforcing member 60 are coupled to the supporters 51*a* and 52*a* have folded portions 61 and 62 so that portions other than both ends and the center portion 60*a* are isolated from the supporters 51*a* and 52*a*.

In the operation of the tension mask frame assembly for a color cathode-ray tube according to the present invention having such a structure, the first and second support members 51 and 52 are pressurized in facing directions so that the first and second elastic members 53 and 54 which support the first and second support members are elastically deformed. At this time, the reinforcing members 60 are welded with the pressurized first and second support members 51 and 52 while their respective center portions are being pressed down on the first and second support members 51 and 52.

In this state, the longer sides of the tension mask 40 are welded with the supporters 51*a* and 52*a* of the first and second support members 51 and 52, respectively. After the welding is completed, the pressures applied to the first and second support members 51 and 52 and the reinforcing member 60 are removed, so that a tensile force is applied to the tension mask 40 by the restoring force of the first and second elastic members 53 and 54. Considering the fact that it is difficult to pressurize the first and second support members with which the reinforcing member 60 is welded, the reinforcing member 60 can be welded with the upper portion of the outer side surface of the first and second support members.

Here, since the center of each of the supporters 51*a* and 52*a* of the first and second support members 51 and 52 is supported by the center portion 60*a* of the reinforcing member 60, the deformation force of the first and second supporters 51 and 52 by the tensile force of the tension mask 40 can be reduced. To be more specific, the center portions of the first and second support members 51 and 52, which are the farthest from portions supported by the first and second elastic members 53 and 54, are the most severely deformed due to the least supportive reaction from the elastic members 53 and 54. The center portions 60*a* of the reinforcing members 60, the ends of which are supported by portions where the first and second support members 51 and 52 are welded with the first and second elastic members 53 and 54, are welded with the center portions of the first and second support members, respectively, such that the maximumly-deformed portions of the first and second support members 51 and 52 are elastically restored in directions opposite to the deformation directions by the reinforcing member 60. Therefore, the deformation force of the center portion of the first and second support members 51 and 52 increases in a direction where a tensile force is applied to the strips, and thus the tension of the center portion of the tension mask 40 increases, so that the tension mask is subjected to a uniform tensile force.

In the tension mask frame assembly for a color cathode-ray tube according to the present invention having such a structure, elastic restoration energy can be increased by the reinforcing member 60 supported by the supporters for securing the tension mask 40. Thus, a uniform tensile force is applied to the tension mask supported by the supporters.

Although the invention has been described with reference to a particular embodiment, it will be apparent to one of ordinary skill in the art that modifications to the described embodiment may be made without departing from the spirit and scope of the invention.

What is claimed is:

1. A tension mask frame assembly for a color cathode-ray tube, the assembly comprising:

a tension mask having a plurality of strips isolated from each other at predetermined intervals on a plate to form slots, and tie bars partitioning slots at a predetermined pitch interval by connecting adjacent strips to each other; and a frame supporting the tension mask, the frame comprising:

a support member supporting a first side of the tension mask, the first side being longer than a second side of the tension mask;

a first and second elastic members being coupled to the support member, the first and second elastic members being a predetermined distance from each other; and a reinforcing member having both ends coupling with the exterior side surface of the support member and a center portion contacting with the support member, the reinforcing member elastically restoring the support member in a direction where a tensile force is applied to the strips.

2. The tension mask frame assembly of claim 1, with both ends of the reinforcing member being folded, the fold of the reinforcing member accommodating an isolation of the reinforcing member from the support member.

3. The tension mask frame assembly of claim 1, with the slots of the tension mask having a first and second protrusions, the first and second protrusions extending toward each other but not touching each other, a gap being formed between the ends of the first and second protrusions.

4. The tension mask frame assembly of claim 1, with the slots of the tension mask having at least one region narrowing in width along the length of the slots.

5. The tension mask frame assembly of claim 1, with each one of the slots of the tension mask having a plurality of rectangular slots connected to each other with narrower inlets.

6. The tension mask frame assembly of claim 1, with the center portion of the reinforcing member contacting the support member, the portions between both ends and the center portion not contacting the support member.

7. The tension mask frame assembly of claim 1, with one end of the reinforcing member contacting the support member toward a first end of the support member and the second end of the reinforcing member contacting the support member towards the second end of the support member.

8. The tension mask frame assembly of claim 1, further comprising:

a second support member parallel with the support member, the second support member supporting a third side of the tension mask, the third side being longer than the second side of the tension mask, the third side being parallel with the first side of the tension mask, the first elastic member supporting the support member and the second support member, and the second elastic member supporting the support member and the second support member, the tension being applied to the tension mask by the support member and the second support member; and a second reinforcing member having the center portion and both ends contacting the exterior side surface of the support member, the reinforcing member elastically restoring the support member in a direction where a tensile force is applied to the strips.

9. The tension mask frame assembly of claim 8, with the center portion of the reinforcing member between portions of each one of the first and second support members being coupled to the first and second elastic members accommodating the reinforcing member restoring the first and second support members elastically outward.

10. The tension mask frame assembly of claim 1, with one end of the reinforcing member being secured adjacent to an end of the first elastic member and a second end of the reinforcing member being secured adjacent to an end of the second elastic member.

11. The tension mask frame assembly of claim 1, with the reinforcing member being made of a flat bar having a width smaller than or equal to the width of the support member.

12. The tension mask frame assembly of claim 11, with the reinforcing member having folded portions at both ends of the reinforcing member coupling with the support member, the reinforcing member being isolated from the support member except at both ends and the center portion of said reinforcing member.

13. The tension mask frame assembly of claim 1, with the reinforcing member having folded portions at the center portion bending the center portion towards the support member.

14. The tension mask frame assembly of claim 1, with the center portion of the reinforcing member supporting a center portion of the support member.

15. The tension mask frame assembly of claim 1, with the reinforcing member being positioned where the ends of the reinforcing member are contacting an area of the support member having the maximum tensile force along the support member, the tensile force being applied to the strips of the tension mask.

16. The tension mask frame assembly of claim 1, with the reinforcing member being located on the support member according to providing a uniform tensile force to the tension mask, the tensile force being applied to the strips of the tension mask.

17. The tension mask frame assembly of claim 1, with the reinforcing member coupled on an upper portion of an outer side surface of the support member.

18. The tension mask frame assembly of claim 1, with the reinforcing member having folded portions at both ends of the reinforcing member coupling with the support member, the reinforcing member being isolated from the support member except at both ends and the center portion of said reinforcing member.

19. A method, comprising the steps of:

placing a tension mask on first and second support members, said first and second support members having a vertical portion and a horizontal portion, said tension mask being supported by said vertical portion and said horizontal portion of said first and second support members;

coupling said first support member to one end of a first elastic member and a second elastic member made of a resilient material;

coupling said second support member to a second end of said first elastic member and said second elastic member;

pressing said first and second support members and said first and second elastic members in directions close to each other, said first and second elastic members being elastically deformed;

coupling a reinforcing member with each one of the pressed first and second support members while a center portion of said reinforcing member is pressed down on said first and second support members;

coupling a long side portion of said tension mask to said vertical portions of said first and second support members; and removing the pressure applied to said first and second support members allowing the tension force from said first and second elastic members to be applied to said tension mask.

20. The method of claim 19, with the reinforcing member being located on the support member according to providing a uniform tensile force to the tension mask, the tensile force being applied to the strips of the tension mask; and with both ends of the reinforcing member being folded, the fold of the reinforcing member accommodating an isolation of the reinforcing member from the support member.

21. The method of claim 19, with the center portion of the reinforcing member contacting the support member, the portions between both ends and the center portion not contacting the support member.

22. An apparatus, comprising:

a tension mask; and a frame supporting the tension mask, the frame comprising:

a support member supporting a first side of the tension mask, the first side being longer than a second side of the tension mask;

a first and second elastic members being coupled to the support member, the first and second elastic members being a predetermined distance from each other; and a reinforcing member having a center portion and both ends contacting the exterior side surface of the support member, the reinforcing member elastically restoring the support member in a direction where a tensile force is applied to the strips, with one end of the reinforcing member being secured adjacent to an end of the first elastic member and a second end of the reinforcing member being secured adjacent to an end of the second elastic member, with the reinforcing member having folded portions at both ends of the reinforcing member coupling with the support member, the reinforcing member being isolated from the support member except at both ends and the center portion of said reinforcing member, the reinforcing member having folded portions at the center portion bending towards the support member, the center portion of the reinforcing member supporting a center portion of the support member.

* * * * *